US007241223B1

(12) United States Patent
Caudill

(10) Patent No.: US 7,241,223 B1
(45) Date of Patent: Jul. 10, 2007

(54) TOY CAR RACING APPARATUS

(76) Inventor: Wesley Caudill, 7285 S. Raccoon, Canfield, OH (US) 44406

( * ) Notice: Subject to any disclaimer, the term of this patent is extended or adjusted under 35 U.S.C. 154(b) by 645 days.

(21) Appl. No.: 10/695,237

(22) Filed: Oct. 27, 2003

(51) Int. Cl.
*A63F 9/24* (2006.01)
*A63F 9/14* (2006.01)

(52) U.S. Cl. ..... 463/62; 463/59; 463/69

(58) Field of Classification Search ..... 463/62; 104/69
See application file for complete search history.

(56) References Cited

U.S. PATENT DOCUMENTS 2,853,301 A * 6/1958 Glass ..... 463/69
3,231,988 A * 2/1966 Freyde ..... 434/63
3,315,632 A * 4/1967 Hyden ..... 116/223
3,403,908 A * 10/1968 Sheldon et al. ..... 463/60
3,502,332 A * 3/1970 Wolf ..... 463/69
3,565,430 A * 2/1971 McRoskey ..... 463/59
3,618,947 A * 11/1971 Cooper et al. ..... 463/60
3,648,454 A * 3/1972 Morrison ..... 368/2
3,707,802 A * 1/1973 Tucker et al. ..... 446/429
3,735,923 A * 5/1973 Brigham et al. ..... 238/10 E
3,986,717 A 10/1976 Kirby et al.
4,077,628 A * 3/1978 Hebert ..... 463/69
4,108,437 A * 8/1978 DeAnda et al. ..... 463/59
4,247,107 A * 1/1981 Smith et al. ..... 463/6
4,291,878 A * 9/1981 Nagel et al. ..... 463/59
4,364,566 A * 12/1982 Neuhierl ..... 463/6
4,438,590 A * 3/1984 Lee ..... 446/438
4,605,229 A * 8/1986 McKay ..... 463/59
4,715,602 A * 12/1987 May et al. ..... 463/60
4,872,680 A * 10/1989 Dennis ..... 463/59
5,651,736 A * 7/1997 Myers ..... 463/64
6,647,893 B1 * 11/2003 Fugitt et al. ..... 104/69

FOREIGN PATENT DOCUMENTS

DE 1703878 B * 6/1978
DE 4114505 A * 11/1992

* cited by examiner

*Primary Examiner*—Robert E. Pezzuto
*Assistant Examiner*—Tramar Harper
(74) *Attorney, Agent, or Firm*—Harpman & Harpman

(57) ABSTRACT

A racing game device for use with non-powered toy vehicles which are released from a starting incline and travel along independent tracks through a finish gate. Electronic starting light tower signals players for remote vehicle release which are electronically interconnected with starting lights and finish gate to indicate winner and elapsed time on a digital display. Sound effects are activated during the start by players remote release mechanism which simulates actual race car sounds.

5 Claims, 12 Drawing Sheets

TOY CAR RACING APPARATUS

BACKGROUND OF THE INVENTION

1. Technical Field

This invention relates to toy car racing tracks which simulate racing between two cars. Such racing simulations include a starting area and a finishing line interconnected by a guide track along which the toy cars travel. Specifically, this invention is directed to non-powered toy race cars known within the industry as "Hot Wheel" type cars that require an initial incline surface on which to gain momentum from the start.

2. Description of Prior Art

Prior art devices of this type have used a variety of different car track configurations emulating drag strip racing in which a pair of toy vehicles are staged and then launched down a short track to determine the fastest vehicle i.e. player based on car performance and player reaction skills, see for example U.S. Pat. Nos. 3,403,908, 3,986,717, 4,605,229, 4,715,602 and 4,876,680.

In U.S. Pat. No. 3,403,908 a drag strip for slot cars is shown in which an electric power supply is connected to each car independently through a simulated shift lever. Photocells are used at the starting line to stage the cars which activate a starting signal light sequence. Finish photocells are used to determine a winner.

U.S. Pat. No. 3,986,717 discloses a method and apparatus for starting model vehicles on a race track wherein self-powered slot type cars are used. Start blocks hold the cars stationery until released by the player's activation.

A toy drag strip and starting tower is illustrated in U.S. Pat. No. 4,605,229 having a plurality of colored marbles within that roll down simultaneously a progressive simulated starting light display ending in a green go marble.

U.S. Pat. No. 4,715,602 claims a racing game apparatus with a pair of inertia powered toy racing vehicles being released from corresponding starting ramps. A trap door in each ramp allows the vehicle release lever to extend from the track to hold and then selectively release the vehicles for the race.

Finally, U.S. Pat. No. 4,876,680 is directed to an electric drag strip apparatus having staging light display for a photo-electric eye positioned at the finish line. A simulated tire burn-out area is featured to emulate race cars in which the tires are rapidly rotated to heat them up for better performance.

SUMMARY OF THE INVENTION

A toy car racing track assembly to provide for competitive racing for toy cars. The track assembly combines an electric staging and starting area having an electrically controlled progressive starting light and a remote finish line area. Remote control car release and staging switches allow players to stage and release their cars independently simulating real racing. The finish line area has mechanically activated electronic timing and winner indication switches that activate corresponding displays.

Sound effects associated with car racing are selectively generated in response to player's input and car position during staging and starting for added realism.

DESCRIPTION OF THE PREFERRED EMBODIMENT

Figure 1:
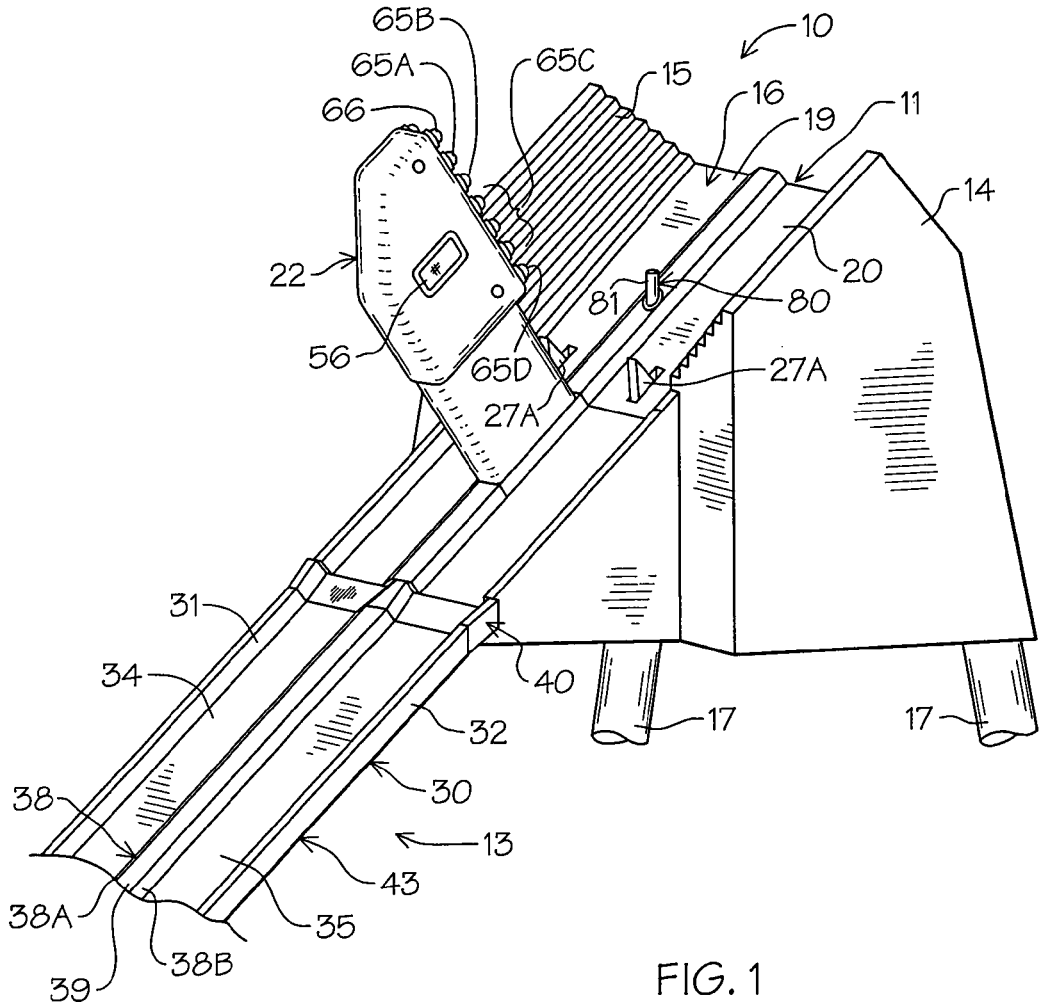
FIG. 1 is a perspective view of the staging start area of the invention.
Figure 2:
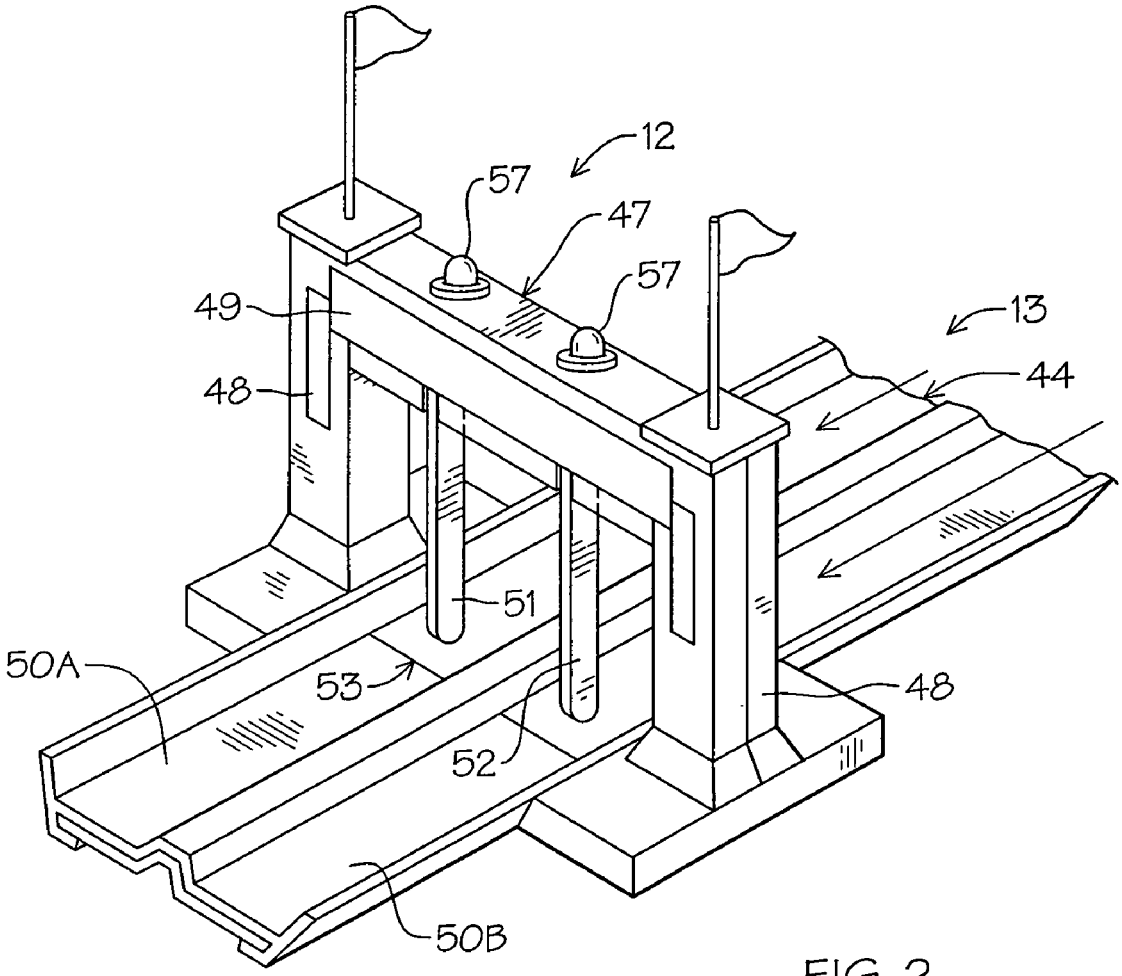
FIG. 2 is a perspective view of the finish line area of the invention.
Figure 3:
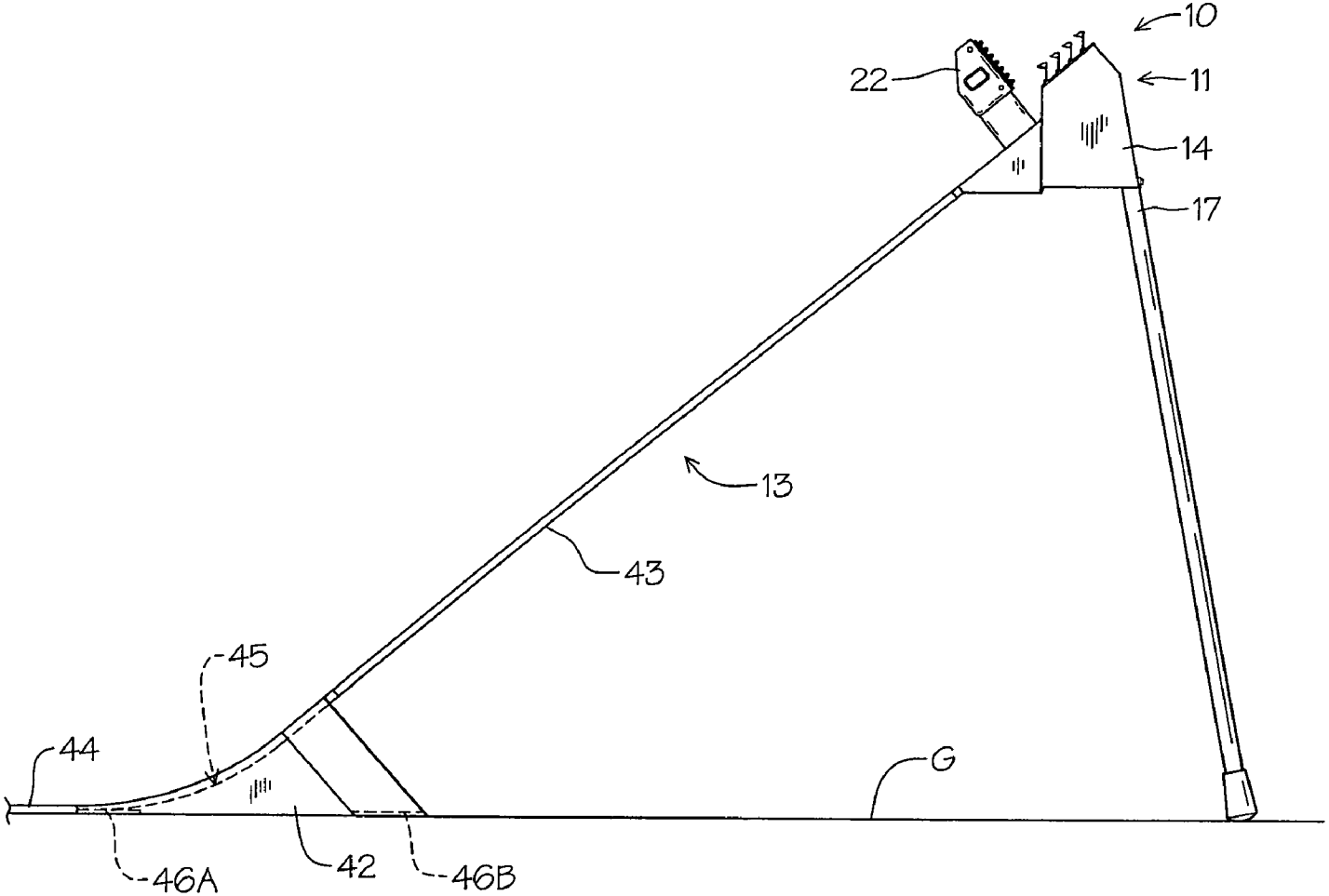
FIG. 3 is a partial side elevational view of the invention.

Referring to FIGS. 1–4 of the drawings, a racing track assembly 10 can be seen having an electric start portion 11 and a finish portion 12 interconnected by a track portion 13. The starting portion 11, best seen in FIGS. 1 and 4 of the drawings has a pair of oppositely disposed interconnected support housings 14 and 15 formed therein in the shape of a grandstand with a staging track area at 16 there between. A pair of legs 17 extend from within the respective housings 14 and 15 supporting the starting portion 11 thereby in elevated relation for placement on a ground surface G as best seen in FIG. 3 of the drawings. The staging track area 16 defines a pair of track paths 19 and 20 on which respective scale model race cars 21 are to be positioned as illustrated in broken lines in FIG. 4 of the drawings.

A starting tower 22 extends from between the respective track paths 19 and 20 in spaced relation to the respective support housings 14 and 15 as hereinbefore described. The starting tower 22 has a plurality of multi-colored indicator lights assemblies 23 positioned in vertical spaced linear alignment on its front surface at 24. The indicator lights assemblies 23 when activated will correspond to a predetermined series of progressive starting instructions by which the racer's (not shown) will react as will be described in detail hereinafter.

Each of the track paths 19 and 20 has an electrical vehicle holding and release assembly 25 positioned under and extending partially within the respective track paths 19 and 20.

Figure 4:
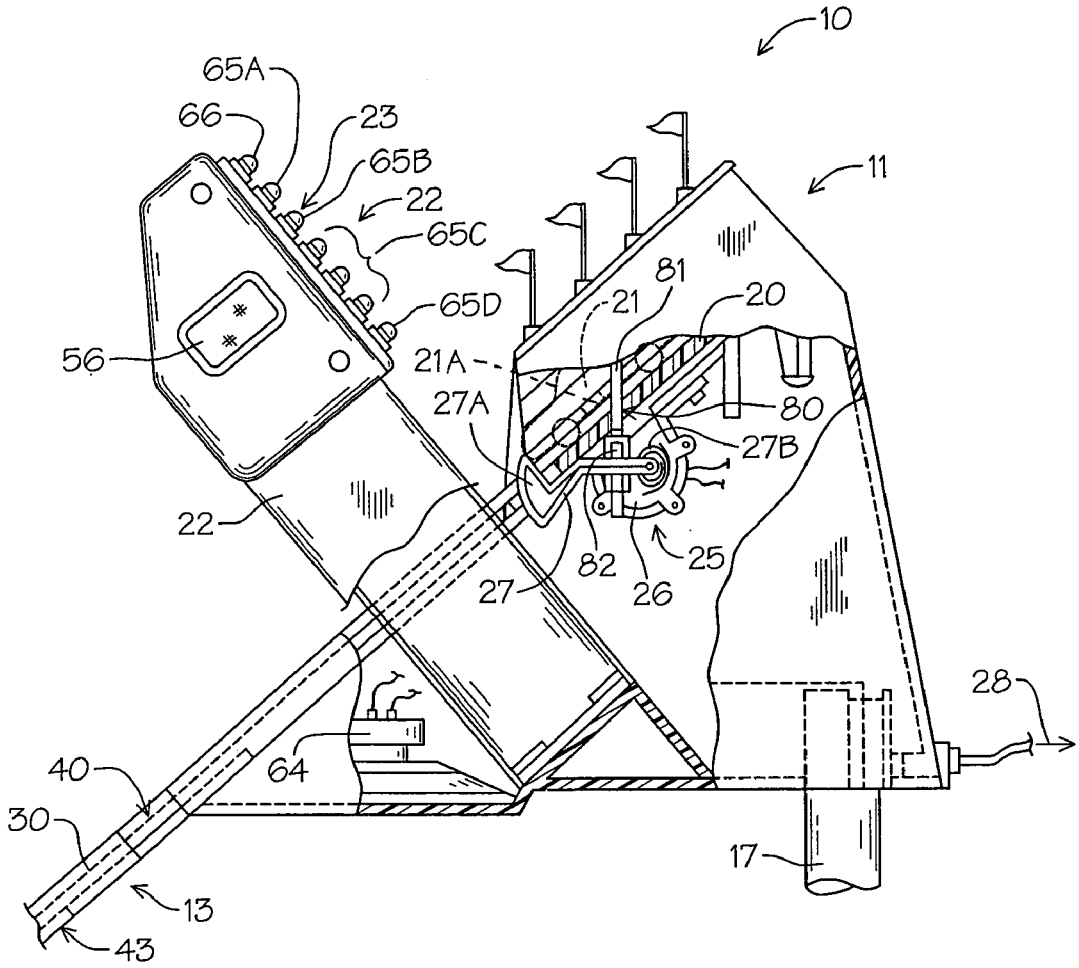
FIG. 4 is a side elevational view of the start portion of the invention with portions broken away.

Referring to FIG. 4 of the drawings, the holding and release assemblies 25 can be seen each having an electric actuation motor 26 with a release arm 27 extending operably there from with an upstanding vertical engagement stop hook 27A on its respective free end, the arms are spring loaded by a pair of resilient elements 27B engaging same. A pair of remote control pedal switches 28 are interconnected to respective actuator motors 26, the indicator lights assemblies 23 through and an electronic control and display circuit 29 which is graphically illustrated in a block flow diagram in FIGS. 16 and 17 of the drawings as will be described in greater detail hereinafter.

Referring to FIGS. 3 and 9–13 of the drawings, the track portion 13 includes multiple track segments 30. Each of the track segments 30, best seen in FIG. 10 of the drawings has oppositely disposed side rails 31 and 32 with continuous support flanges 33A and 33B extending there from. A pair of co-planar track surfaces 34 and 35 extend from between the respective side rails 31 and 32 with respective engagement channels 36 and 37 there between. A central upstanding track divider 38 extends longitudinally between the track surfaces 34 and 35. The track divider 38 has spaced disposing angular incline side surfaces 38A and 38B and an integral top 39 there between. A track segment connector fitting 40 of the invention can be seen in FIGS. 11, 12 and 13 of the drawings having a pair of contoured track engagement flanges 40A and 40B with an upstanding transversely extending track abutment band 41 there between. Respective band side rails 41A and divider 40C are correspondingly upstanding and are longitudinally angularly inclined. In use, the interengagement flanges 40A and 40B are registerably positioned within the respective channels 36A and 36B of adjacent track segments 30 and so correspondingly configured track engagement end surfaces of the start portion 11 and finish portion 12 for registration therein. It will be noted that due to the aforementioned angular inclination of the band side rails 41A and 41B that an effective non-resistant adjoining surface transition is achieved there between.

Referring back to FIG. 3 of the drawings, a curved angular inclined transitional track surface fitting 42 can be seen defining a transition between inclined track segment portions 43 extending from the elevated starting position 11 and a horizontally disposed track segment portions at 44 extending from the finish portion 12. The transitional track surface fitting 42 is contoured hollow body with a track surface 45 formed within and along its upper curved linear surface. Oppositely disposed interconnecting registration back-up plates 46A and 46B are positioned below each end for support. Adjacent abutting track sections 30 are registerable therewith.

Figure 7:
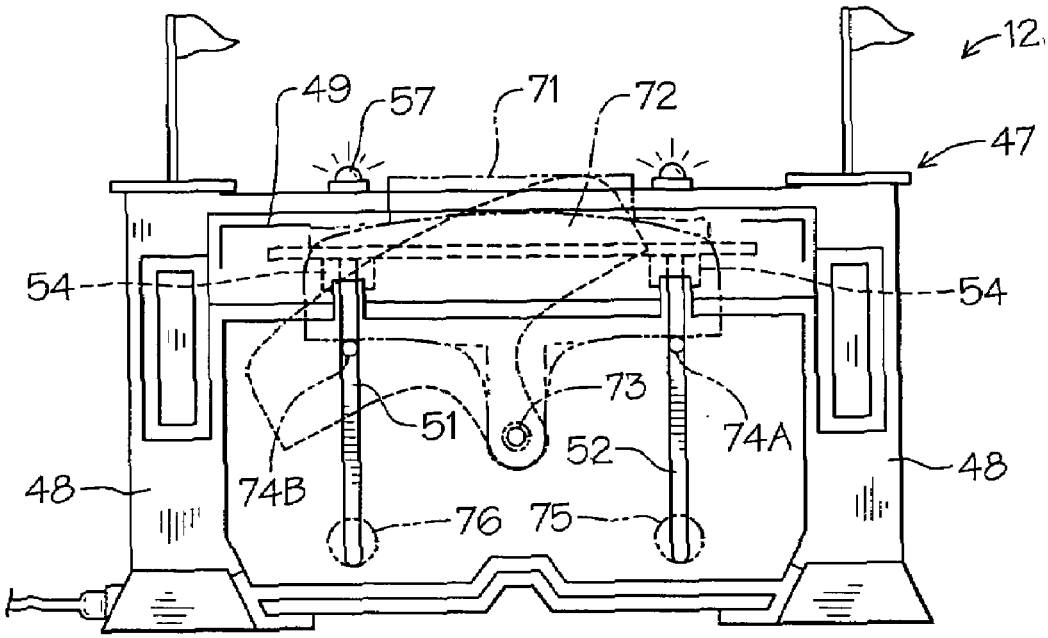
FIG. 7 is a front elevational view of the finish line portion.
Figure 8:
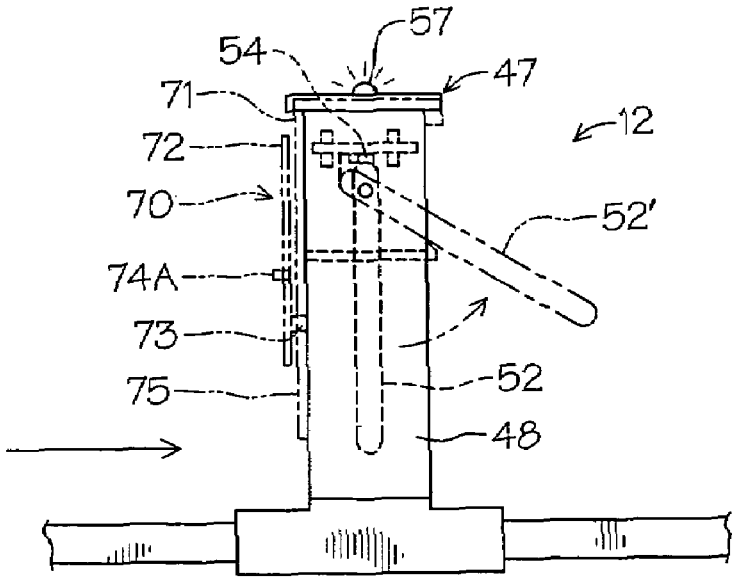
FIG. 8 is a side elevational view of the finish line portion.
Figure 9:
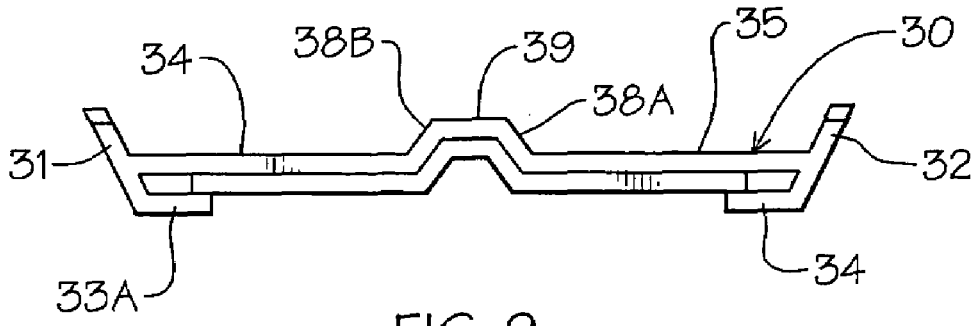
FIG. 9 is a front elevational view of interconnected track sections of the invention.
Figure 10:
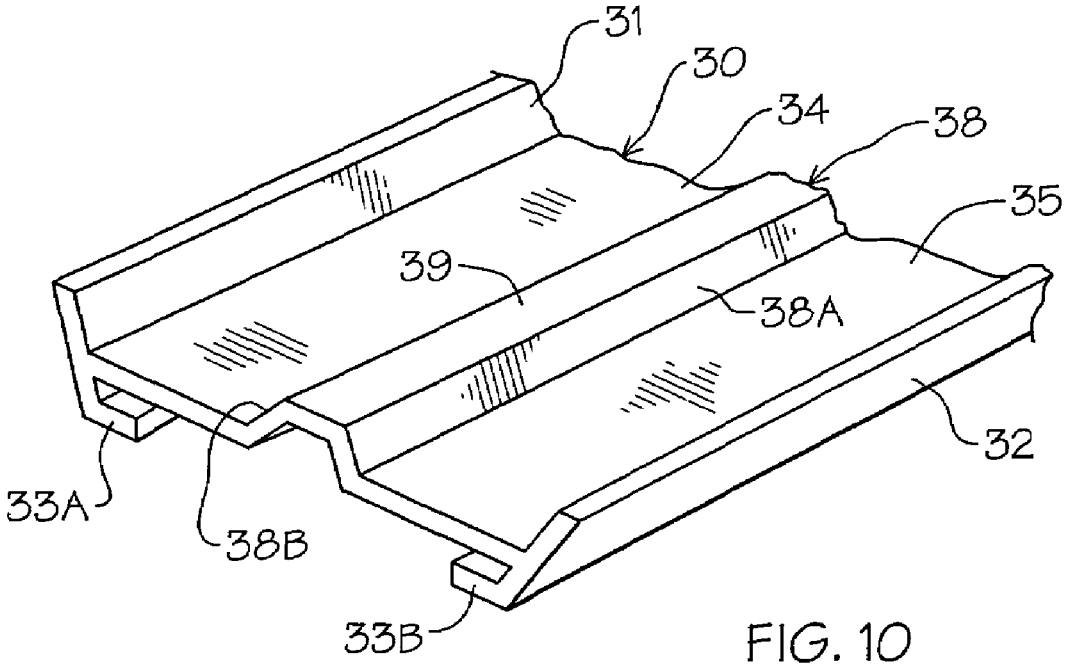
FIG. 10 is a perspective view of the track section of the invention.
Figure 12:
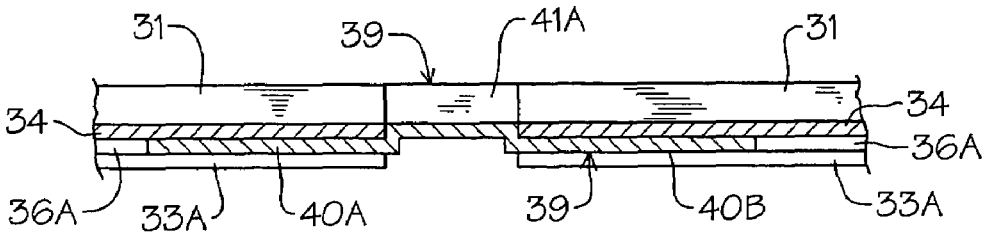
FIG. 12 is partial sectional view on lines 11—11 of FIG. 8.
Figure 11:
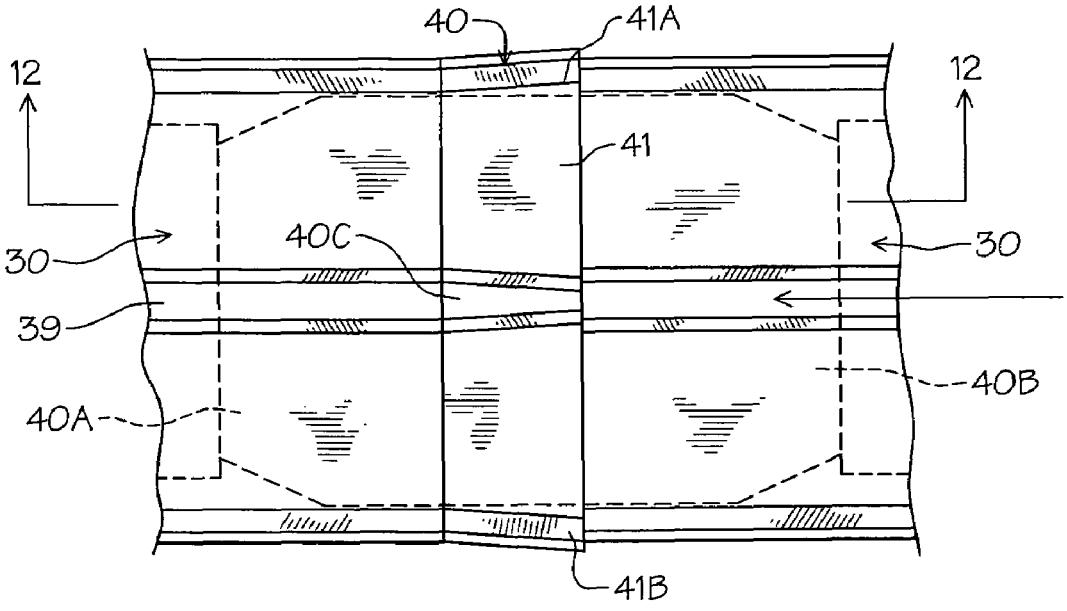
FIG. 11 is a top view of interconnected track sections of the invention with portions broken away.
Figure 13:
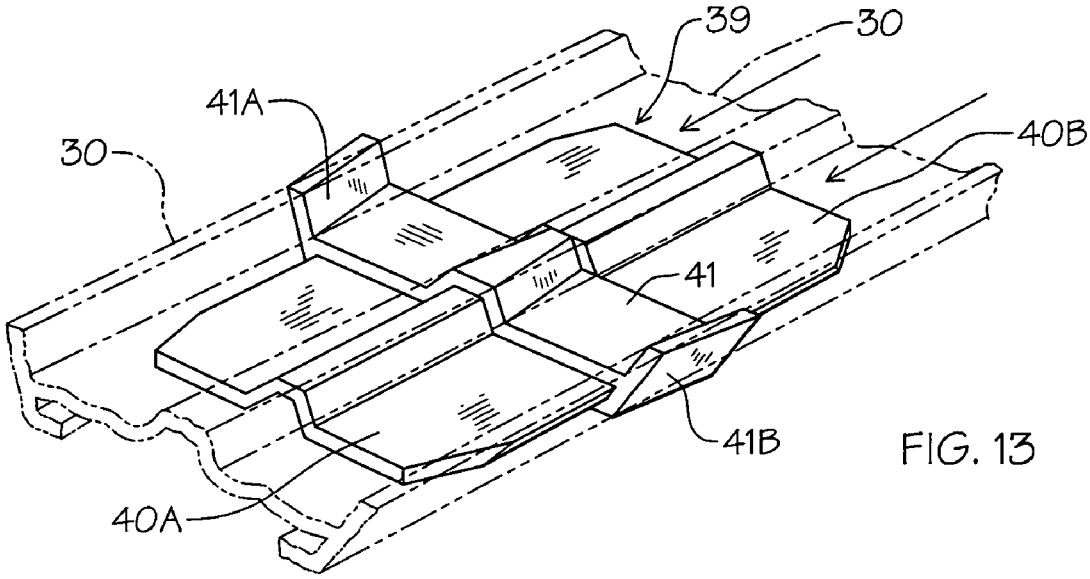
FIG. 13 is a bottom plan view of the track interconnector of the invention.

The finish portion 12 has a finish line gate assembly 47 as best seen in FIGS. 2, 7, and 8 of the drawings positioned at the end of the horizontal track segments 44 and has a pair of spaced upstanding columns 48 that are interconnected by a bridge closure 49 which is in spaced relation to finish line track surfaces 50A and 50B, best seen in FIG. 2. A pair of pivoted finish engagement flags 51 and 52 extend downwardly from the bridge enclosure 49 through respective openings therein. The finish engagement flags 51 and 52 are so positioned as to be above respective track surfaces 50A and 50B. The finish engagement flags 51 and 52 pivot upon contact with the race cars 21 after crossing a finish line 53 during play. The finish flags 51 and 52 so pivoted trip respective optical interrupters 54 which are in communication with the electronic control circuit 29, shown in FIG. 17 of the drawings, which will correspondingly register the elapsed time of the respective race cars and calibrate a winner and display elapsed time on an interconnected numerical display 56 located on the starting tower 22 and illuminate the respective winning lights 57A or 57B above the respective winning track on the finish gate 45.

Figure 16:
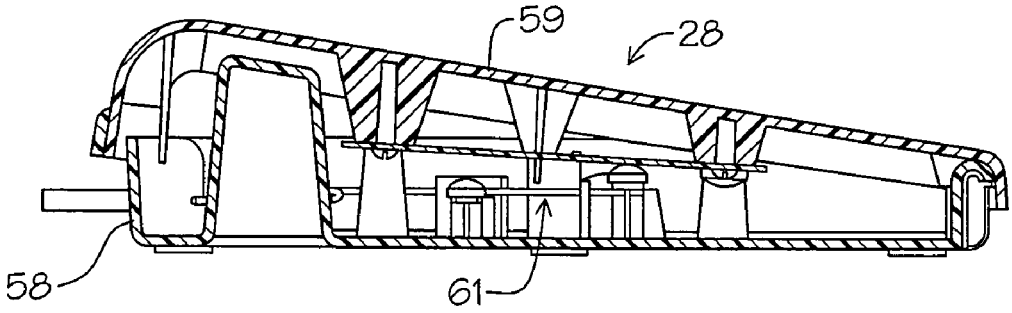
FIG. 16 is an enlarged cross-sectional view of the staging and starting switch.
Figure 17:
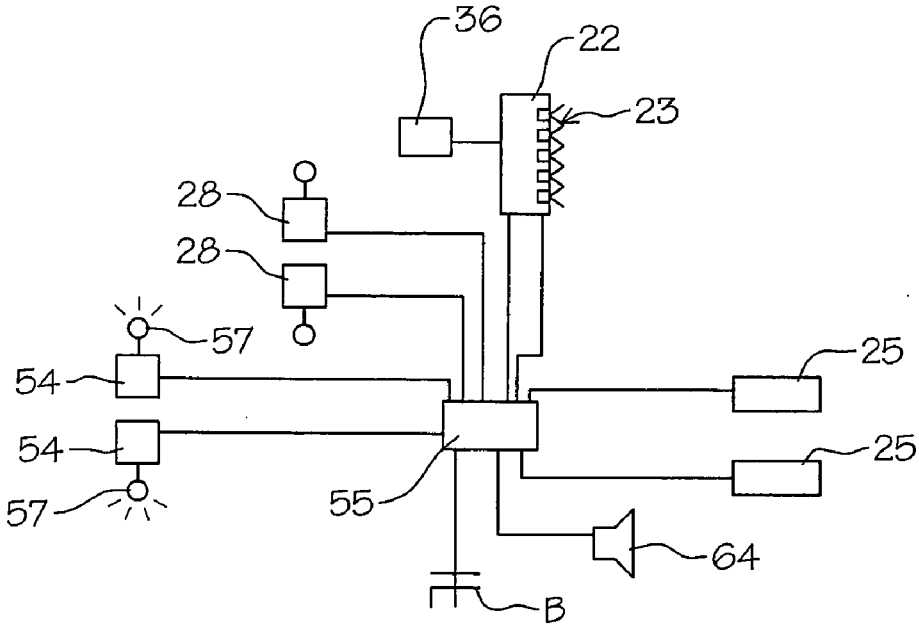
FIG. 17 is a block flow diagram of control circuit of the invention.

In use, for a typical two car race, a pair of the racing cars 21 are positioned on the track paths 19 and 20 on the staging track area 16. The race cars 21 are held immobile on the inclined track surface by the respective stop hooks 27A portions of the arm 27 as hereinbefore described. The remote control pedal switches 28 as seen in FIG. 16 of the drawings have a housing 58 with a movable interengaging surface pedal 59 interdisposed thereon. The pedals 59 are resiliently held in position by respective spring members 60. An electric contact switch assembly 61 is selectively engaged by an actuation rod 62 depending from the respective pedals 59 completing an electrical circuit signaling the control circuit 55 as will be well understood by those skilled in the art.

Figure 5:
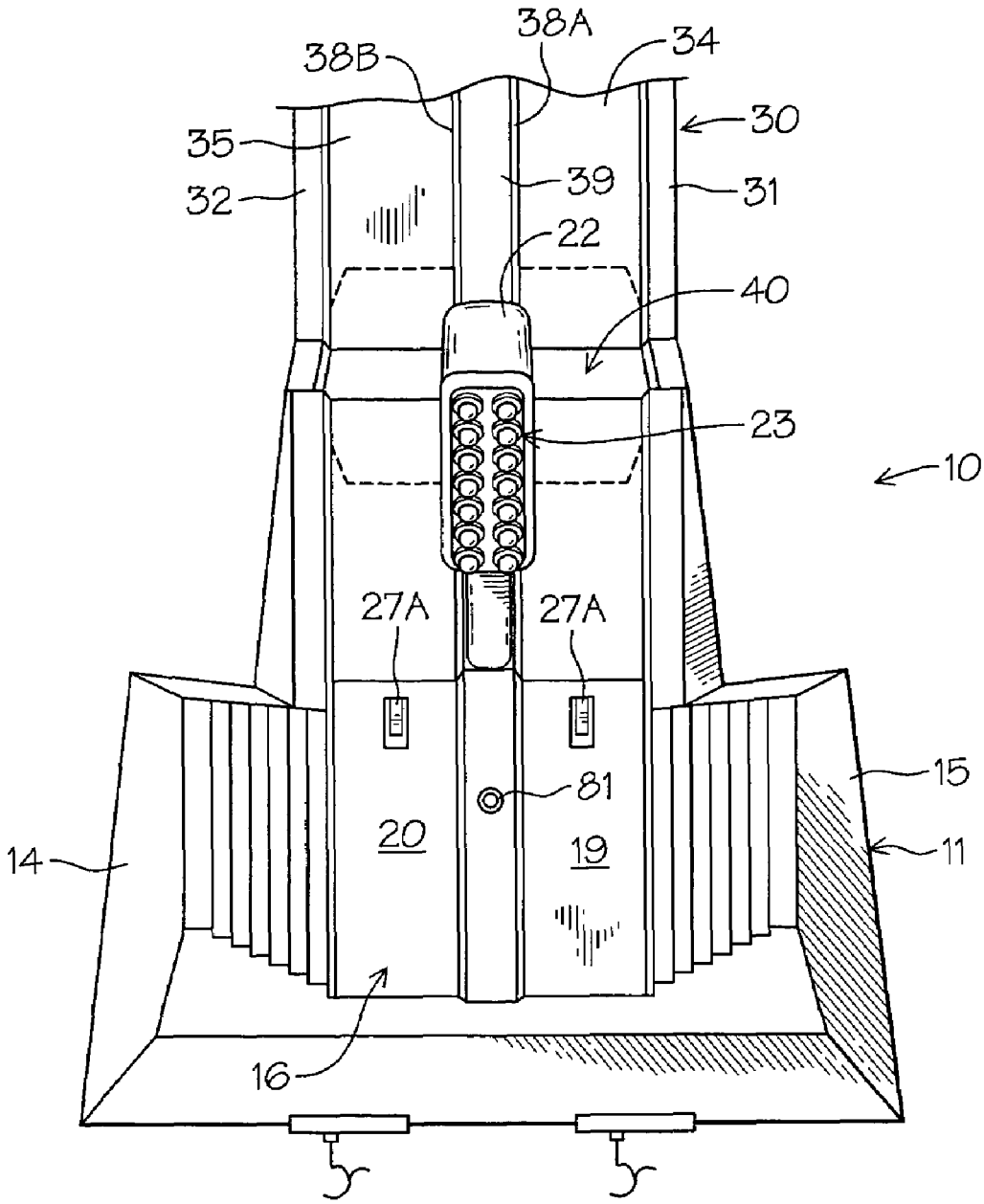
FIG. 5 is a top plan view of the start portion.
Figure 6:
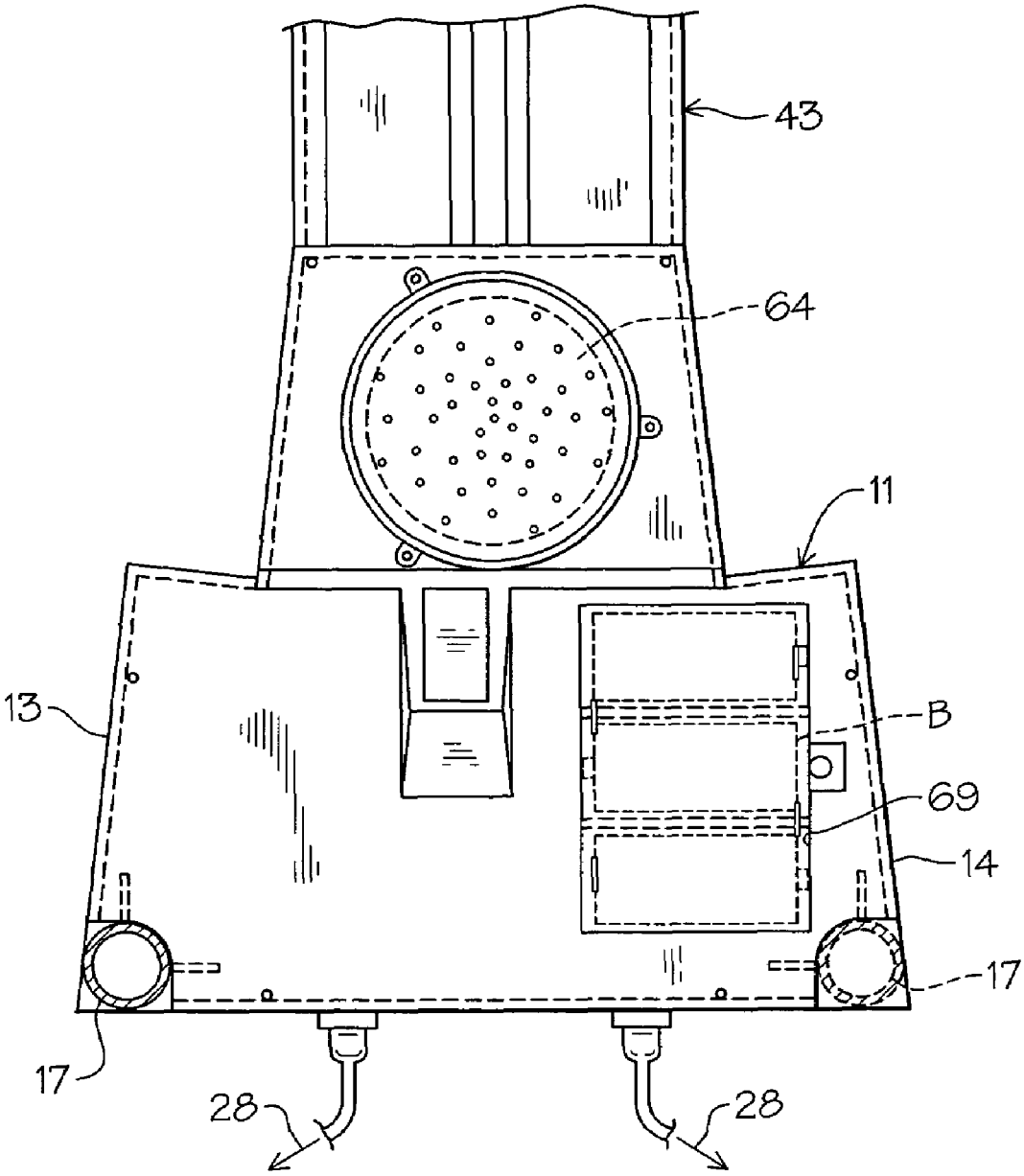
FIG. 6 is a bottom plan view of the start portion.

Upon initial pedal depression by the players (not shown) of the race cars 21 are effectively staged activating simultaneously staging lights 63 on the light assemblies 23 and race car sounds stored electronically and played through a sound speaker 64, best seen in FIGS. 4, 5 and 6 of the drawings within the starting portion 11. Then a starting time lighting sequence is activated progressively illuminating respective lights in the lighting assemblies 23 on the starting tower 22.

Figure 14:
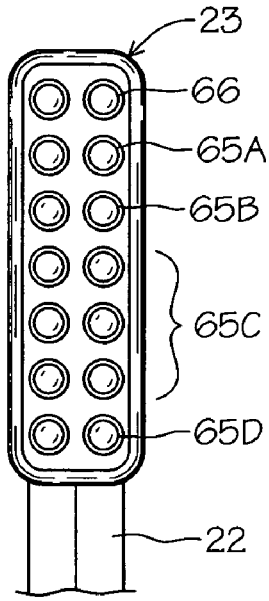
FIG. 14 is an enlarged partial front elevational view of the starting light tower of the invention.
Figure 15:
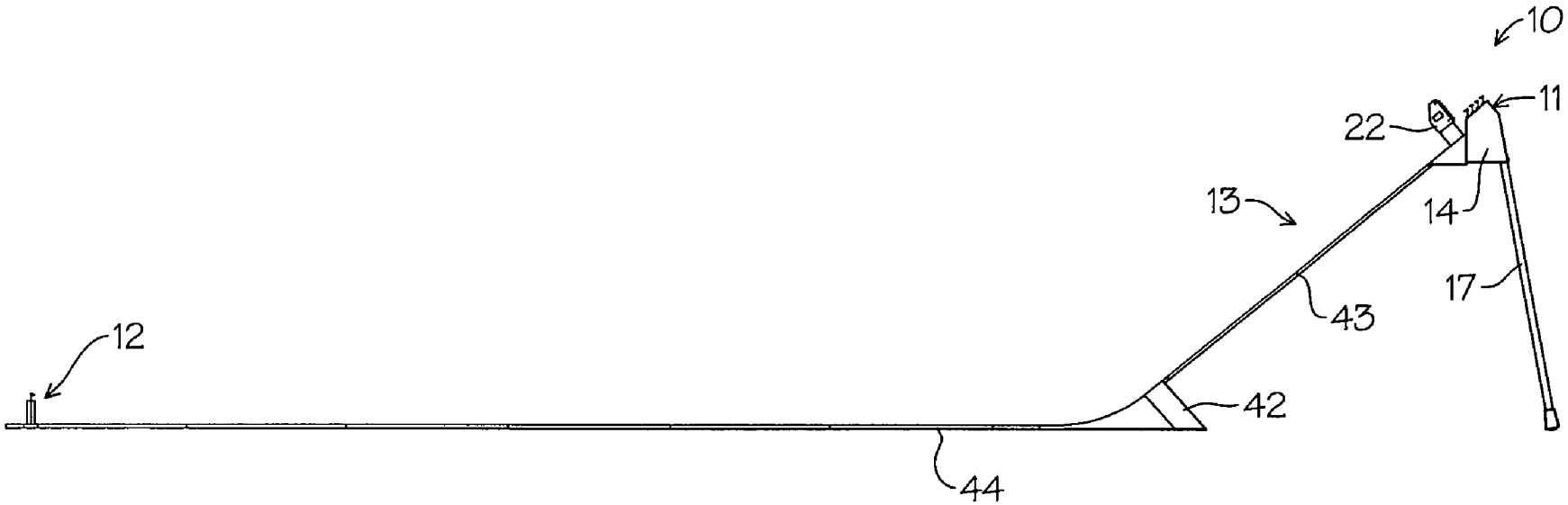
FIG. 15 is a side elevational view of the entire race track of the invention.

The light assemblies 23 lighting sequence comprises a pair of pre-stage on/off yellow lights 65A, player activated staging lights 65B and then sequential count down lights 65C, including green start lights 65D and red foul lights 66 as illustrated best in FIG. 14 of the drawings. As in real races the light sequence count down after staging has begun with the final green lights 65C indicating to the drivers to release the cars 21 which they do by depressing the respective pedals 59 a second time. Upon pedal depression, the DC motors 26 are actuated with the hereinbefore described hook portion 27A against the pre-loaded pressure spring allow the cars 21 to roll free down the respective race track paths 19 and 20 of track portion 13 down the track 43, over the transition fitting 42 and across the horizontally oriented track sections 44 through the finish gate 47 and against the respective engagement finish flag arms 51 and 52 signaling the winner and elapsed time, as noted. The control circuit 55 and interconnecting starting switch assemblies 61, light assemblies 23, graphic display 56, finish gate 47, and sound speaker 64, are all powered by batteries B within a battery holder 69 in the base of the starting gate 11, best seen in FIGS. 4 and 5 of the drawings. Supplemental power can also be supplied by a transformer (not shown) interconnected to 110 volt AC power source as will be typical and well known within the art.

Referring to FIGS. 7 and 8 of the drawings, a manual finish line indicator attachment assembly 70 shown in broken lines can be seen having attachment fitting 71 that is secured over the bridge portion 49 of the finish gate 47 displacing the electronic finish flags 51 and 52 as seen in FIG. 8 of the drawings at 52'. A contoured win indicator plate 72 is centrally pivoted at 73 and is releasably held in position by a pair of respective tabs 74A and 74B extending from a pair of manual engagement target areas 75 and 76 pivotally connected to the attachment fitting 71.

The contoured win indicator plate 72 will pivot right or left indicating the winning car lane when the corresponding targets 75 or 76 are hit by the respective winning race car 21 releasing same.

The manual finish line indicator assembly 70 can be used, for example, if the batteries B fail or there is no alternate source of power as suggested and noted above.

Individual players (not shown) can manually stage their cars and release them without utilization of electronic control circuit and other aspects of the apparatus described above by use of a manual stage and release assembly 80 as seen in FIG. 4 of the drawings. A spring-urged push button 81 extends up through the staging track area 16 between the respective car paths 19 and 20. The button 81 has a pair of oppositely disposed actuation bars 82 extending there from engageable against the respective release arms 27. A player (not shown) can push the manual button 81 releasing the cars 21 staged in the event of power failure as will be understood by those skilled in the art.

Referring back to FIG. 1 of the drawings, the race cars 21 may also have independent self-powered illumination devices indicated at 21A so as to provide reflective illumination onto the corresponding track assembly surfaces.

It will thus be seen that a new and novel toy car racing apparatus has been illustrated and described and it will be apparent to those skilled in the art that various changes and modifications may be made therein without departing from the spirit of the invention.

I claim:

1. A car racing game device comprising:

a starting gate, a finish gate, and a track assembly interconnecting there between;

said starting gate having an inclined track portion thereon defining track paths and elevation support post extending therefrom;

a car release assembly on said starting gate selectively extending through corresponding opening in said track paths;

a starting tower on said starting gate having a vertically aligned colored sequential starting light assembly, an informational display, and a foul light;

said finish gate having an finish engagement flags means extending therefrom engageable by independent race cars on said respective track paths;

said track assembly comprises multiple track sections registerably secured to each other by connector fittings and to said finish and starting gates;

said track sections have oppositely disposed parallel side rails with depending engagement channels, an upstanding track divided there between, and said connector fitting having an upstanding abutment band defining interconnecting track path surfaces;

means for remotely activating said car release assembly; and an electronic control circuit for interconnecting said car release assembly, finish engagement flags, and an electronic sound effect generator in communication with said remote activation means and source of electrical power.

2. The car racing game device set forth in claim 1, wherein each of the said car release assemblies comprises:

an activation motor, a release arm operably extending therefrom, a vehicle engagement stop, and release portion on said arm; and said arm movable from a first car engagement position to a second car release position, resilient means holding said arm in said first position.

3. The car racing game device set forth in claim 1, wherein said means for remotely activating said car release assembly comprises:

a pair of starting pedal electrical switches selectively interconnected thereto.

4. The car racing game device set forth in claim 1, wherein said finish engagement flags means comprise:

a pair of extended arms, optical interrupters in communication with said arms, and finish lights on said finish gate.

5. The car racing game device set forth in claim 1, wherein said source of electrical power is storage batteries within said starting gate.

* * * * *